US007067980B2

(12) United States Patent
Sadwick et al.

(10) Patent No.: US 7,067,980 B2
(45) Date of Patent: Jun. 27, 2006

(54) SHINGED STRUCTURES FOR VACUUM MICROELECTRONICS AND METHODS OF MANUFACTURING SAME

(76) Inventors: Larry Sadwick, 3767 E. Brockbank Dr., Salt Lake City, UT (US) 84124; Ruey-Jen Hwu, 3767 E. Brockbank Dr., Salt Lake City, UT (US) 84124

( * ) Notice: Subject to any disclaimer, the term of this patent is extended or adjusted under 35 U.S.C. 154(b) by 101 days.

(21) Appl. No.: 10/775,266

(22) Filed: Feb. 10, 2004

(65) Prior Publication Data

US 2004/0227468 A1 Nov. 18, 2004

Related U.S. Application Data

(60) Provisional application No. 60/446,831, filed on Feb. 11, 2003.

(51) Int. Cl.
*H01J 25/34* (2006.01)

(52) U.S. Cl. ..... 315/39.3; 315/3.5

(58) Field of Classification Search ..... 315/500–507, 315/3.5, 3.6, 39.3; 313/359.1
See application file for complete search history.

(56) References Cited

U.S. PATENT DOCUMENTS 2,957,103 A * 10/1960 Birdsall ..... 315/3.6
3,069,588 A * 12/1962 Skowron et al. ..... 315/3.6
3,227,914 A * 1/1966 Birdsall et al. ..... 315/3.5
3,244,932 A * 4/1966 Eric ..... 315/3.6
3,322,996 A * 5/1967 Schrager ..... 315/3.5
3,353,058 A * 11/1967 Froom ..... 315/3.5
3,370,197 A * 2/1968 Cyril ..... 315/3.5
3,508,108 A * 4/1970 Salisbury ..... 315/3.5
4,178,533 A * 12/1979 Ribout et al. ..... 315/3.6
4,388,602 A * 6/1983 Dodds ..... 335/212
4,949,047 A * 8/1990 Hayward et al. ..... 315/505
6,584,675 B1 * 7/2003 Rajan et al. ..... 29/600
6,917,162 B1 * 7/2005 Dayton, Jr. ..... 315/39.3

* cited by examiner

*Primary Examiner*—Don Wong
*Assistant Examiner*—Leith A. Al-Nazer
(74) *Attorney, Agent, or Firm*—Morriss O'Bryant Compagni

(57) ABSTRACT

An improved Klystron device is disclosed which has opposed electrostatic (ES) magnetic field generating members which are uniformly spaced along a longitudinal axis to form an electron beam chamber. The ES magnetic field generating members produce a magnetic flux which confines an electron beam passing through the chamber when an alternating current (AC) is imposed upon the magnetic field generating members. An additional improvement includes a chamber formed from a single sheet of electron conductive metal having a ladder-like structure symmetrical about a longitudinal hinge which permits the structure to be folded about the hinge to form a suitable electron beam chamber.

22 Claims, 4 Drawing Sheets

SHINGED STRUCTURES FOR VACUUM MICROELECTRONICS AND METHODS OF MANUFACTURING SAME

PRIORITY CLAIM

This application claims the benefit of the filing date of U.S. Provisional Patent Application Ser. No. 60/446,831, filed Feb. 11, 2003.

BACKGROUND OF THE INVENTION

1. Field of the Invention

The invention relates to Klystron and TWT devices which have a magnetically focused electron beam, including electrostatically focused beams.

2. State of the Art

Klystron devices, for example, with electrostatically focused beams have been constructed with focusing lenses rather than permanent magnets such as that illustrated in FIG. 1.

U.S. Pat. No. 5,821,693 illustrates and describes a recent improvement in Klystron construction. Magnets, either permanent or electrostatic are brazed to the external surface of a tube. These magnets must be placed by hand in a precise manner and then brazed in place. Precise placement by hand is difficult and brazing limits the temperature at which the Klystron may be operated.

BRIEF SUMMARY OF THE INVENTION

Improved infrastructures for electron beam containing cavities has been invented. Ladder-like structures made by photolithographic/micromachining processes to form miniature ladder-like structures capable of being nested provide significant improvement in weight and power amplification for Klystron and TWT devices.

The precise structures are made by applying a precise mask by photolithographic technique and etching the substrate, generally an electroconductive metal, to form ladder-like structures of precise dimensions. The unremoved portions of the sheet form a ladder with spaced rungs and parallel rails. The spacing between rungs has micron-rigid tolerances and the spacing is such that rungs form an elongated ladder-like structure may superposed and interspersed with sufficient air gaps to prevent arcing or shorting.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Improvements in the fabrication and structure of electrostatically (ES) focused Klystrons have been achieved by employing microfabrication techniques. Unique, precise infrastructures for Klystron and TWT devices may be readily fabricated to have low, micron-sized tolerances. The infrastructures further permit multi-cavity devices of miniature dimensions to be made thereby providing high amplification devices which are small in size and light in weight.

Unique, elongated ladder-type structures which are formed as identical pairs are placed together to form an elongated tunnel (electron cavity). The ladder-like structure is illustrated in FIGS. 2 and 3.

Figure 1:
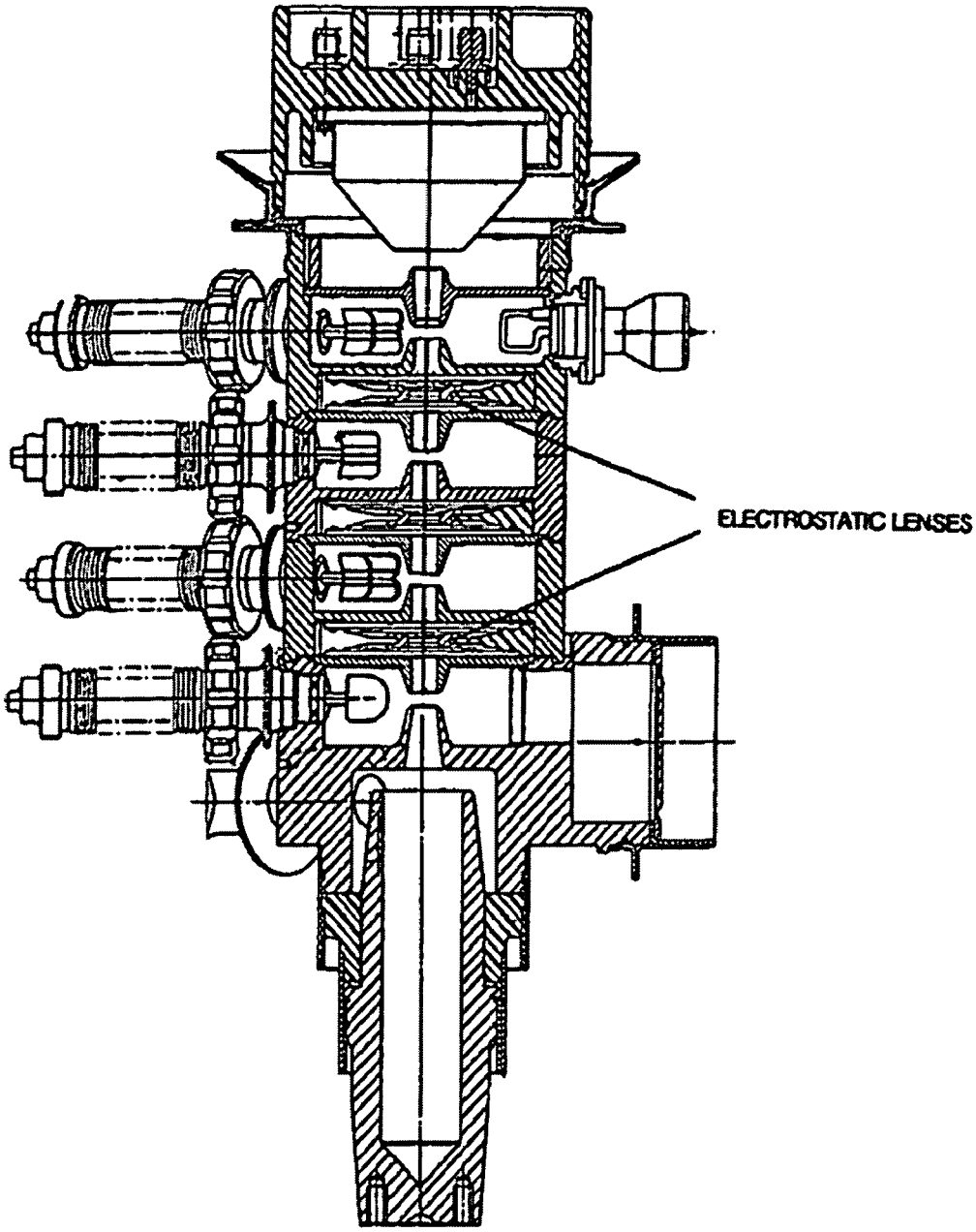
FIG. 1 (Prior Art)
FIG. 1 is an illustration of a prior art Klystron device with electrostatic focusing lenses.
Figure 2:
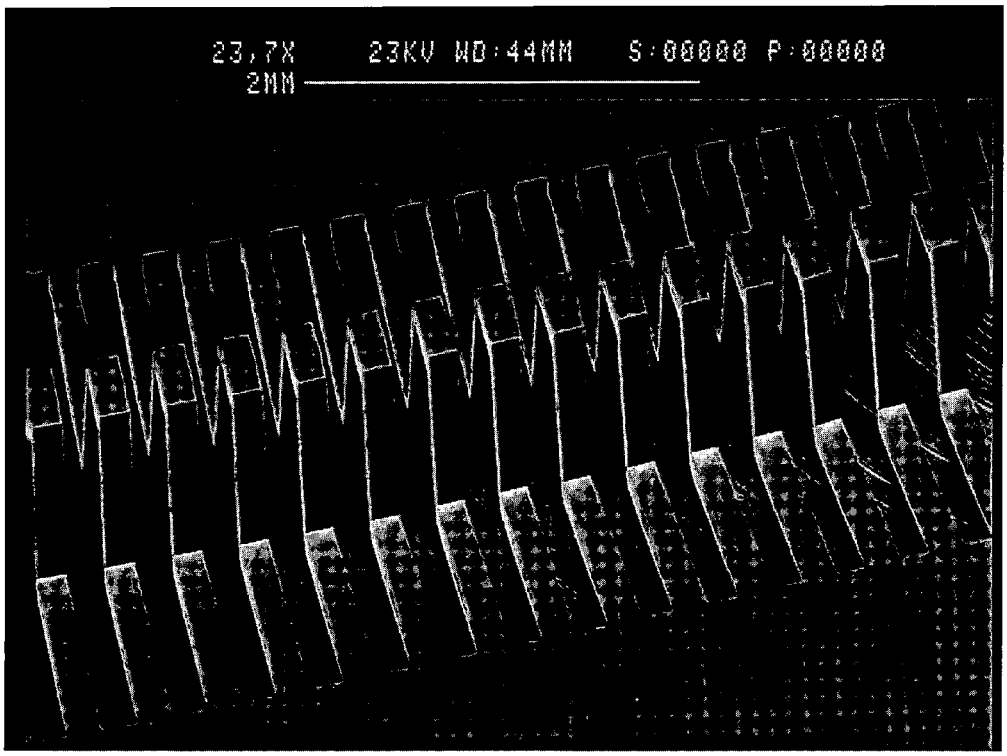
FIG. 2 is a perspective view of a single ladder-like structure made by micromachining techniques.

FIG. 2 is a perspective view of a single ladder-like electroconductive structure wherein the cross-members (rungs) are recessed from the plane of the elongated ladder rails.

Figure 3:
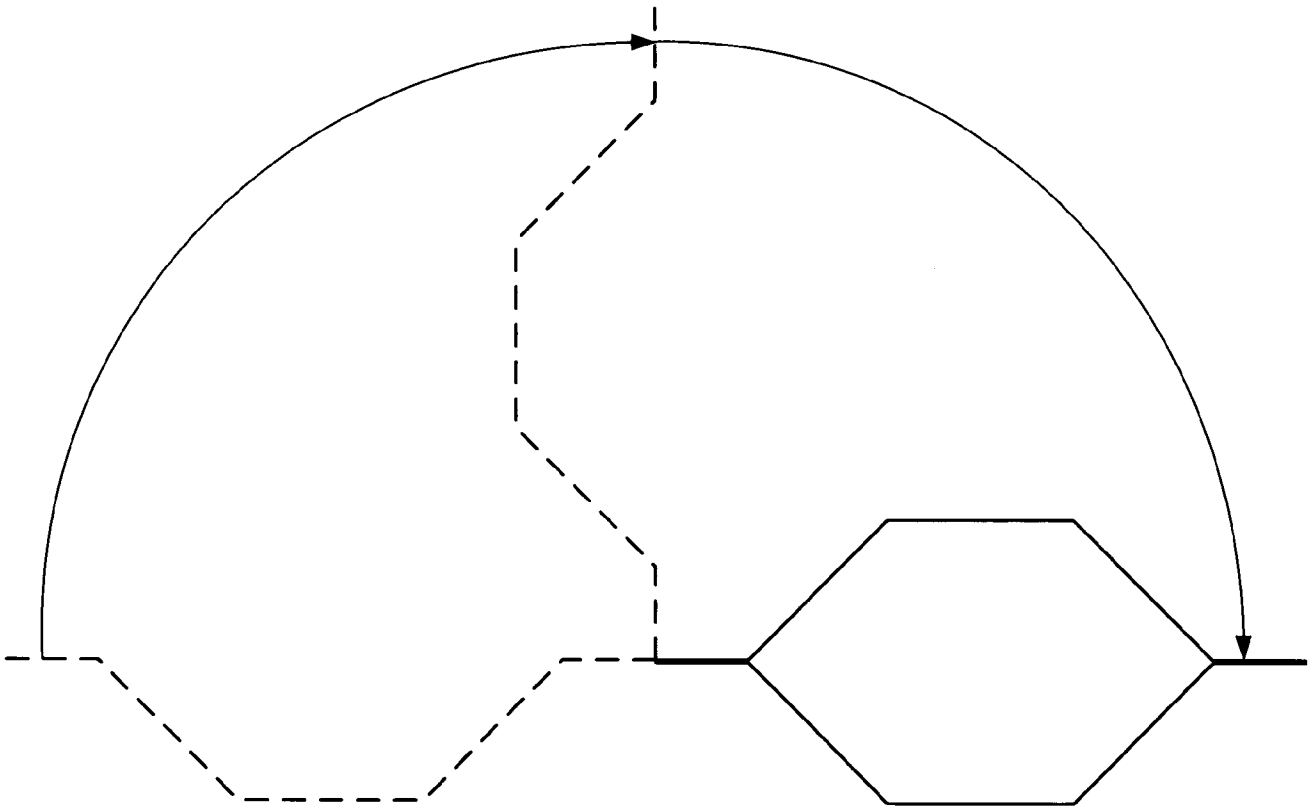
FIG. 3 illustrates two ladder-like structures in a face-to-face relationship, whereby a precise tunnel may be formed by folding one ladder over the other along the hinge axis.
Figure 4:
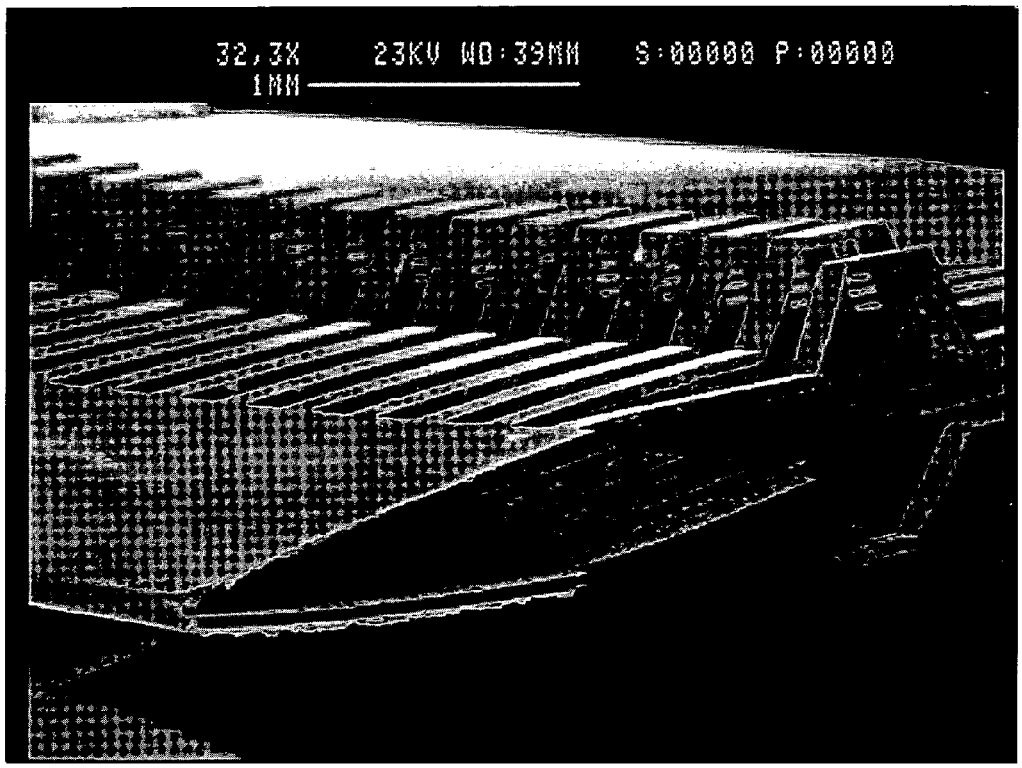
FIG. 4 illustrates schematically a second set of ladders shaped and structured to nest between rungs of a first pair of opposed ladders forming an elongated tunnel.

FIG. 3 shows two ladder-like structures positioned in a face-to-face relationship to create an elongated tunnel having a hexagonal, cross-sectional shape.

A second set of ladder-like structures of a similar shape to the structure shown in FIG. 2 is superposed on the opposed structures of FIG. 3 whereby the rungs are sized and shaped to fit between the rungs of the structures in FIG. 3. The gaps between rungs of the FIG. 2 structure must be sufficiently wide to accommodate rungs of a second superimposed ladder so that the rungs of the second ladder are interspersed between the rungs of the first ladder with sufficient space on either side of adjacent rungs to prevent arcing or shorting between rungs.

The rails of the second superposed "ladder" are preferably separated from the rails of the first "ladder" by an electrical insulating material. The rungs of the first and second ladders may be of the same or slightly different dimensions. Each set of ladders will preferably have substantially the same geometric shape for its rungs. Opposed rungs forming a hexagonally shaped, elongated cavity are readily formed although the rungs could be half circles, e.g., so that a cylindrically shaped tunnel could be formed. Also, a tunnel with square or rectangular cross-sectional shape can be readily constructed. A hexagonally or octagonally shaped tunnel is preferred since a more uniform magnetic field can be created where the tunnel cross-section more closely approximates a circle.

Thus, a compact precise tunnel may be formed from four ladder-like structures of an electro-conductive material, e.g. copper, moly and similar conductive metals as well as conductive ceramics, silicon and the like.

One pair of ladders, top and bottom, with rungs directly opposed to one another is connected to an alternating current of RF frequency to create an electrostatically field (magnetic field) within the tunnel to maintain a beam of electrons flowing from an electron gun cathode in a tightly confined beam. The other pair of ladders, top and bottom are connected to a slow wave source of a.c. The slow wave current, in a simusoidal wave preferably, creates a field which causes bunching of the electrons, causing the electrons to slow.

The energy lost by the slowing electrons is captured by an RF field projected by a transmitting antenna located near the front end of the tunnel with a receiver antenna located near the beam discharge end of the tunnel. Thus, as shown in the attached tables, significant amplification of the RF field results from a Klystron having the ladder-type structures forming an electron beam tunnel.

The construction of a pair of opposed ladder-type structures is facilitated by forming such a pair from a single sheet of material having an elongated hinge whereby the axis of rotation of said hinge is parallel with the central longitudinal axis of the tunnel formed by folding one ladder-like structure over its twin along the hinge joint to form a structure such as that shown in FIG. 5. This novel structure facilitates ready alignment of one ladder with an opposed ladder to form an electron beam tunnel. A hinged structure is illustrated in FIG. 5. The pair of interlacing, superposed ladders may also be made from a single sheet of material with a hinge joint.

Design of TWTA with Electrical Focusing System

Structure Instruction

1. Dimensions

All dimensions are scaled from Kory's structure according to pitch ratio except the following:

Short position given in the table;

Dielectric constant of cube 4.1;

Inserted electrical focusing system:

a. Thick of plate: 0.09807 mm;

b. Distance to waveguide side wall: 0.09807 mm;

c. Distance to waveguide bottom: 0.09807 mm.

2. The Electrical Focusing Structure

The two plates are connected together by ladders and in the same positive potential, and the waveguide are grounded. We have another version in which the two plates are separated and not in same potential as well as waveguide not grounded, which will be released in the future if necessary.

In the electrical focusing structure, the original ladders are cut every another required by the focusing voltage. The functions of the plates provide a big capacitance for the compensation of displacement current as well as the supporting mechanism. The outlet of the electrical plates are through the two small cubes, which can be found under the plates. The simulations show that there is no significant RF performance influence from the two ports, largely because of the plate capacitance function.

3. RF Performance Influenced by Electrical Focusing Structure

It is noticed there is significant influence by the introduction of electrical focusing structure. The significant influences include the increased dispersive, increased wave length or wave speed (resulting in a higher required anode voltage), increased attenuation, as well as increased deformation of waveform in space (or space spectrum). Efforts have been made to reduce the side effect as small as possible. However, up to date the performance can not be thought as optimum. The future work will be needed depending the feedback from other engineer who performs the process.

The structure is intended for the design of V band, however in principal this design can be extended to Ka band by the structure scaling according to frequency ratio. We can evaluate the feasibility roughly, and then move further if necessary.

TABLE 1

| Performance Table Pitch = 0.190221978 mm | | |
|---|---|---|
| Frequency | 51 GHz | 52 GHz |
| Slow wavelength λc | 1.3319 mm | 1.1463 mm |
| Phase shift per cavity | 51.41° | 59.73° |
| Slow wave velocity Vp | 0.679 E8 m/s | 0.596 E8 m/s |
| Attenuation per cavity | 0.18 dB/per cavity | 0.29 dB/per cavity |
| Interaction impedance Zc | 165 Ω | 152 Ω |

TABLE 1-continued

| Performance Table Pitch = 0.190221978 mm | | |
|---|---|---|
| Frequency | 51 GHz | 52 GHz |
| Required anode voltage to match wave speed | 13,000 v | 10,000 v |
| Gain parameter C @ ia = 60 mA | 0.0575 | 0.061 |
| Gain of 64 cavities | 3.78 dB | 2.58 dB |
| Gain of 70 cavities | 5.03 dB | 3.71 dB |
| Gain of 80 cavities | 7.11 dB | 5.61 dB |
| Gain of 90 cavities | 9.19 dB | 7.50 dB |
| Gain of 100 cavities | 11.28 dB | 9.4 dB |
| Gain parameter C @ ia = 80 mA | 0.0672 | |
| Gain of 64 cavities | 6.28 dB | 5.67 dB |
| Gain of 70 cavities | 7.77 dB | 7.09 dB |
| Gain of 80 cavities | 10.24 dB | 9.47 dB |
| Gain of 90 cavities | 12.71 dB | 11.89 dB |
| Gain of 100 cavities | 15.18 dB | 14.22 dB |
| VSWR at input port | 1.38 | 1.29 |
| Short position from axis | 2.888 mm | 2.888 mm |

Magnetic Field Focusing in TWT Slow Wave Structure

The simulations of beam current profile as a function of static focusing magnetic field are shown in the following tables for both Ka band and V band. The simulations are conducted under a slow wave structure of 16 ladder, with given injected beam current and observed current after 16 ladders. A perfect focusing profile is no difference between input and output beam current. From the following results, we can clearly see that the required magnetic field intensity to maintain a perfect beam focusing is increased as the beam radius decreases and current intensity increases.

TABLE 2

| | Ka Band (30 GHz) Pitch = 0.31797 mm Beam radius = 0.2459 mm | | V Band (50 GHz) Pitch = 0.19022 mm Beam radius = 0.147 mm | |
|---|---|---|---|---|
| Injected beam | 60 mA | 80 mA | 60 mA | 80 mA |
| Beam current after 16 ladders | | | | |
| B = 0.1 Tesla | 38.2 mA | | | |
| B = 0.2 Tesla | 55.7 mA | | | |
| B = 0.3 Tesla | 58.3 mA | 74.1 mA | 55.7 mA | |
| B = 0.5 Tesla | 60.0 mA | 77.9 mA | 58.3 mA | 74.0 mA |
| B = 0.7 Tesla | | 78.0 mA | 58.9 mA | 77.8 mA |
| B = 0.9 Tesla | | 80.0 mA | 60.0 mA | 78.3 mA |
| B = 1.2 Tesla | | | | 80. mA |

Although the following results show a big difference among different applied magnetic field, no significant differences are observed from beam image trajectories. So the final design should be always based on the detailed numerical results, not the qualitative image pictures.

What is claimed is:

1. A pair of self-alignable, ladder-like structures integral with one another in a single sheet of electroconductive material wherein a hinge joint is formed parallel to the rails of said ladder-like structures by folding 180° along a hinge line separating said ladder-like structures and wherein rungs of each of said ladder-like structures are sized and spaced to be aligned with one another when said hinge joint is in a closed position and to form an elongated tunnel therebetween.

2. The integral pair of self-alignable, ladder-like structures of claim 1, wherein the electroconductive material is sufficiently malleable to have the pair of ladder-like structures folded about a continuous linear hinge member to form an elongated cavity configured as a linear bore.

3. The integral pair of self-alignable, ladder-like structures of claim 1, wherein said electroconductive material is curable to form a rigid structure.

4. The integral pair of self-alignable, ladder-like structures of claim 3, wherein said rigid structure comprises a circular cross-section.

5. The integral pair of self-alignable, ladder-like structures of claim 3, wherein said rigid structure comprises a hexagonal cross-section.

6. The integral pair of self-alignable, ladder-like structures of claim 3, wherein said rigid structure comprises a octagonal cross-section.

7. The integral pair of self-alignable, ladder-like structures of claim 3, wherein said rigid structure comprises a square cross-section.

8. The integral pair of self-alignable, ladder-like structures of claim 3, wherein said rigid structure comprises copper or copper alloys.

9. The integral pair of self-alignable, ladder-like structures of claim 3, wherein said rigid structure comprises molybdenum or molybdenum alloys.

10. A pair of ladder-like structures positioned in register with one another to form a tunnel therebetween wherein said structures are integral with one another by folding 180° along a hinge joint axis parallel to the longitudinal axis of said tunnel.

11. The pair of ladder-like structures of claim 10, wherein said hinge joint axis is configured to allow said pair of ladder-like structures to fold and form said tunnel having a defined cross-section.

12. The pair of ladder-like structures of claim 11, wherein said defined cross-section is selected from the group consisting of: circular, square, hexagonal and octagonal.

13. The pair of ladder-like structures of claim 11, wherein said tunnel comprises at least one of: copper, copper alloy, molybdenum, molybdenum alloy, conductive ceramic and silicon.

14. A method for fabricating a precise miniature ladder-type device of a thin malleable electroconductive sheet of material comprising:

applying a precise mask by photolithographic techniques of the desired structure on a thin electroconductive sheet;

etching the unmasked portions to remove precisely the unmasked portions of the sheet material to result in a ladder-like structure with precisely spaced rungs;

forming the etched sheet along its longitudinal axis to recess the rung members from the plane of the sheet; and folding the etched sheet 180° along a hinge line onto itself to form the ladder-type device.

15. A precise miniature ladder-type device formed according to the method of claim 14.

16. The precise miniature ladder-type device of claim 15, wherein said precise miniature ladder-type device is configured to be folded 180° along a hinge line to form a rigid structure having a defined cross-section.

17. The precise miniature ladder-type device of claim 16, wherein said defined cross-section is selected from the group consisting of: circular, square, hexagonal and octagonal.

18. The method of claim 14, further comprising separating said ladder-like structure from a substrate.

19. The method of claim 18, further comprising folding 180° along a hinge line formed between two half-structures of the ladder-like structure to form a rigid structure having an elongated cavity configured as a linear bore.

20. The method of claim 19, wherein the rigid structure comprises a cross-section shape selected from the group consisting of: circular, square, hexagonal and octagonal.

21. The method of claim 14, further comprising providing a substrate from which said precise miniature ladder-type device is formed.

22. The method of claim 21, wherein providing a substrate comprises providing an electroconductive material comprising at least one of: copper, copper alloy, molybdenum, molybdenum alloy, conductive ceramic and silicon.

* * * * *